US009351584B1

(12) United States Patent
Rizzardo et al.

(10) Patent No.: US 9,351,584 B1
(45) Date of Patent: May 31, 2016

(54) SPLIT BED WITH IMPROVED CHARACTERISTICS

(71) Applicant: GF Health Products, Inc., Atlanta, GA (US)

(72) Inventors: Dennis Paul Rizzardo, Fond du Lac, WI (US); Ryan Rosenow, Greenville, WI (US)

(73) Assignee: GF Health Products, Inc., Atlanta, GA (US)

( * ) Notice: Subject to any disclaimer, the term of this patent is extended or adjusted under 35 U.S.C. 154(b) by 124 days.

(21) Appl. No.: 14/052,530

(22) Filed: Oct. 11, 2013

Related U.S. Application Data

(60) Provisional application No. 61/713,285, filed on Oct. 12, 2012.

(51) Int. Cl.
*A47C 27/08* (2006.01)
*A47C 19/00* (2006.01)
*A61G 7/012* (2006.01)

(52) U.S. Cl.
CPC ..... *A47C 19/005* (2013.01); *A61G 7/012* (2013.01)

(58) Field of Classification Search
CPC ..... A47C 27/08
USPC ..... 5/11, 611, 620
See application file for complete search history.

(56) References Cited

U.S. PATENT DOCUMENTS

| | | | | |
|---|---|---|---|---|
| 3,305,876 | A * | 2/1967 | Hutt | 5/11 |
| 5,095,562 | A * | 3/1992 | Alexander | 5/616 |
| 5,636,394 | A | 6/1997 | Bartley | |
| 5,964,347 | A | 10/1999 | Urness | |
| 6,601,271 | B1 | 8/2003 | Sommerfeld et al. | |
| 8,042,210 | B2 | 10/2011 | Clenet | |

* cited by examiner

*Primary Examiner* — Fredrick Conley
(74) *Attorney, Agent, or Firm* — Brannen Law Office, LLC

(57) ABSTRACT

The present invention relates to a split bed with improved characteristics, and in particular to a split bed with joinable sections including a connector used to join two pieces of a drive assembly, that has tab and slots to accommodate accessory devices and that is easily movable by one person. In one embodiment, the bed has a deck with several slotted tabs for receiving accessory devices. Two joinable sections are provided. The sections can be joined with six points of contact. A two part drive assembly is also provided. A pivotal connector is provided for joining the two parts of the drive assembly. The drive assembly moves cross members relative, and preferably within, longitudinal support members. In this regard, movement of the cross members causes the bed to selectably raise or lower. The bed is compactable to a very low height for shipping.

3 Claims, 15 Drawing Sheets

SPLIT BED WITH IMPROVED CHARACTERISTICS

This United States utility patent application claims priority on and the benefit of provisional application 61/713,285 filed Oct. 12, 2012, the entire contents of which are hereby incorporated herein by reference.

BACKGROUND OF THE INVENTION

1. Field of the Invention

The present invention relates to a split bed with improved characteristics, and in particular to a split bed with joinable sections including a connector used to join two pieces of a drive assembly, that has tab and slots to accommodate accessory devices and that is easily movable by one person.

2. Description of the Related Art

Many beds exist for many purposes. Some examples include: U.S. Pat. No. 5,636,394 to Bartley is titled Hospital Bed with Rack and Pinion Stabilizer. This patent shows a hospital bed including a base adapted to roll over the floor, a litter disposed on the base upon which the patient rests, a lift assembly designed to selectively position the litter a selected vertical distance above the base and at least one stabilizer unit between the litter and the base. Each stabilizer unit includes a pair of rack-and-pinion assemblies that extend between the base and the litter. The pinions of the rack-and-pinion assembly are connected together to rotate in unison. Owing to the interconnection of the pinions, the rack-and-pinion assemblies are prevented from moving vertically in directions opposite to each other. This lock-out of the rack-and-pinion movement prevents the litter from moving side-to-side. The stabilizer unit thus prevents the undesirable side-to-side rocking movement of the litter.

U.S. Pat. No. 5,964,347 to Urness is titled Package for a Bed Section and a Method Packaging the Bed Section. This patent shows a package for bed sections and a method of packaging the bed sections includes the head and foot ends which are structured and dimensioned to fit together within a single package so as to form a single parcel and a head section and a foot section, each structured and dimensioned to fit within separate packages so as to form separate parcels. The head and foot ends as well as the head and foot sections each have a length and a girth the sum of which is in the order of 127 inches. A package is provided for containing the head and foot ends, the head section, and the foot section. The package comprises a paperboard box having a length and a girth sum of which does not exceed 130 inches. Neither the head nor foot ends, nor the head section, nor the foot section, and its paperboard box, have a combined weight exceeding 150 pounds. A formula is provided for determining a range of dimensions for the head and foot ends, and the head section, and the foot section. The sum of the length and girth of the paperboard box are known. The paperboard box is fabricated from a paperboard material having a known thickness. The thickness of the paperboard material is factored into the formula used to determine the range of dimensions for the head and foot ends and the head section and the foot section. This permits the head and foot ends and the head section and the foot section to be structured and dimensioned to fit within a paperboard box of limited dimensions.

U.S. Pat. No. 8,042,210 to Clenet is titled Articulating Bed System. The patent shows a mechanism for activation of an articulating bed incorporates at least one mattress support plate and a pair of side rails. A rack is attached to each side rail and a torque tube extends between the side rails with a pinion gear at each end engaging a respective one of the racks. An actuator imparts translational motion to the torque tube perpendicular to its axis. Elevation bars connected to the torque tube and the support plate are angularly displaced by translation of the torque tube.

While each of these patents may work well for their intended purposes, none solve the unique problems that are solved by the present invention. Thus there exists a need for an improved bed that solves these and other problems.

SUMMARY OF THE INVENTION

The present invention relates to a split bed with improved characteristics, and in particular to a split bed with joinable sections including a connector used to join two pieces of a drive assembly, that has tab and slots to accommodate accessory devices and that is easily movable by one person. In one embodiment, the bed has a deck with several slotted tabs for receiving accessory devices. Two joinable sections are provided. The sections can be joined with six points of contact. A two part drive assembly is also provided. A pivotal connector is provided for joining the two parts of the drive assembly. The drive assembly moves cross members relative, and preferably within, longitudinal support members. In this regard, movement of the cross members causes the bed to selectably raise or lower. The bed is compactable to a very low height for shipping.

According to one advantage of the present invention, the bed is formed in two sections, a head section and a foot section. This allows for easy transport and assembly. Advantageously, the sections can be joined together and can have six contact points to form a strong and stable connection. The contact points remain in secure engagement under a vertical loading condition, as the heavier the load, the more the contact points are forced against each other.

According to another advantage of the present invention, the drive assembly has two parts that can be joined together with a pivoting connector. In this regard, the pivoting connector can connect the shafts of the drive assembly when the head and foot sections of the bed are joined. Likewise, the drive assembly can be disconnected for decreased shipping size (compact to a low shipping position of seven inches in height).

In an alternative embodiment, the two parts of the drive assembly can be selectably joined and disconnected via a sliding or telescopic connector as well. A sliding connector can save space and require less clearance relative adjacent components.

According to another advantage of the present invention, the bed is collapsible to a very low shipping height. This advantageously allows for more density in shipping. This also allows for fewer containers or boxed to be required when packaging the present invention.

According to a still further advantage of the present invention, a screw drive is provided for causing both the head and foot section of the bed to raise and lower. The drive has cross members with translators that maintain stability of the bed. In one embodiment, the translators can be pinions that are operable relative racks within longitudinal supports. The racks in the preferred embodiment can be on the top of the longitudinal supports.

According to a still further advantage of the present invention, the deck has a plurality of tabs connected to the perimeter rail. The tabs each have slots therein. The tabs are interior of the perpendicular rail so that the spacing of the slots is appropriate for accessory devices.

According to a still further advantage of the present invention, a second pin can be provided to provide vertical support (prevent sagging) when the two sections are joined. The second pin can be swung into a corresponding slot as the head and foot sections are pivotally rotated relative each other.

According to a still further advantage of the present invention, in an alternative embodiment, actuators can be used to control raising and lowering of the bed. In this preferred embodiment, a pin or similar device can be used to control the lowest position of the bed during use. The pin can be removed to allow the bed to be placed in an even lower position for storage or shipping.

Related, and in a preferred embodiment, the pin can be part of an automatically extending pin. In this regard, the bed can be shipped with the pin retracted allowing for a ship position. Yet, when the bed is raised from the shipping position for the first time, the pins can extend and create a new stop for the low running position. This also advantageously relieves pressure from the actuators when the bed is reduced to the low position and the weight of the bed (and anything supported by the bed) is supported by the pins instead of the actuator.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
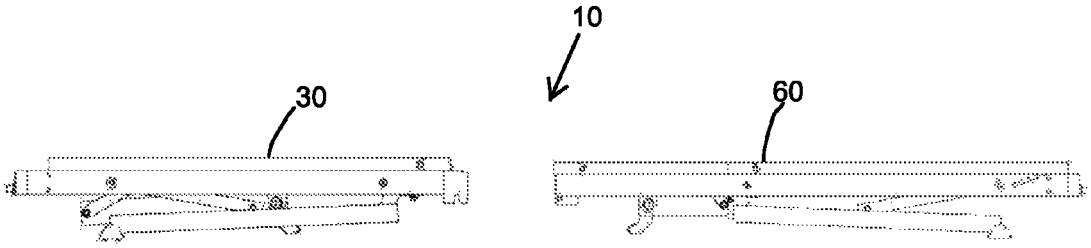
FIG. 1 is a side view of the bed of the present invention shown in the shipping position.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

One preferred embodiment of the present invention is illustrated in FIGS. 1-14. Yet, it is appreciated that many alternatives are possible without departing from the broad aspects of the present invention.

A bed 10 is provided having a top 11, a bottom 12, ends 13 and 14 and sides 15 and 16. The bed 10 can be selectably raised and lowered as described below.

Figure 13:
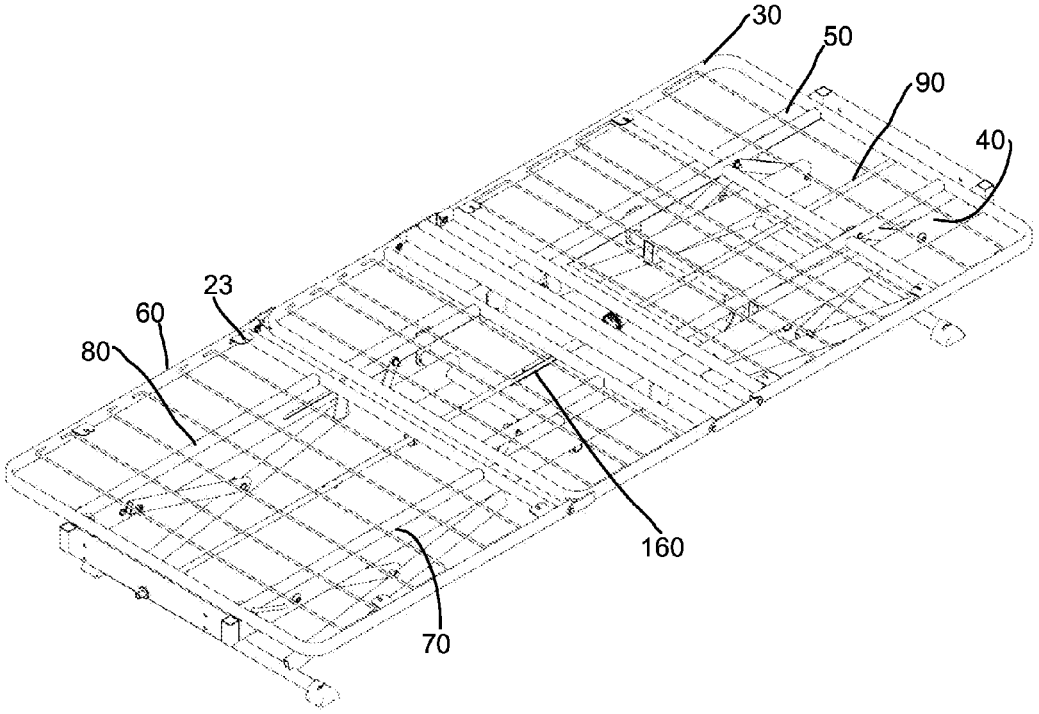
FIG. 13 is a perspective view of a preferred deck embodiment showing several tabs with slots therein.
Figure 14:
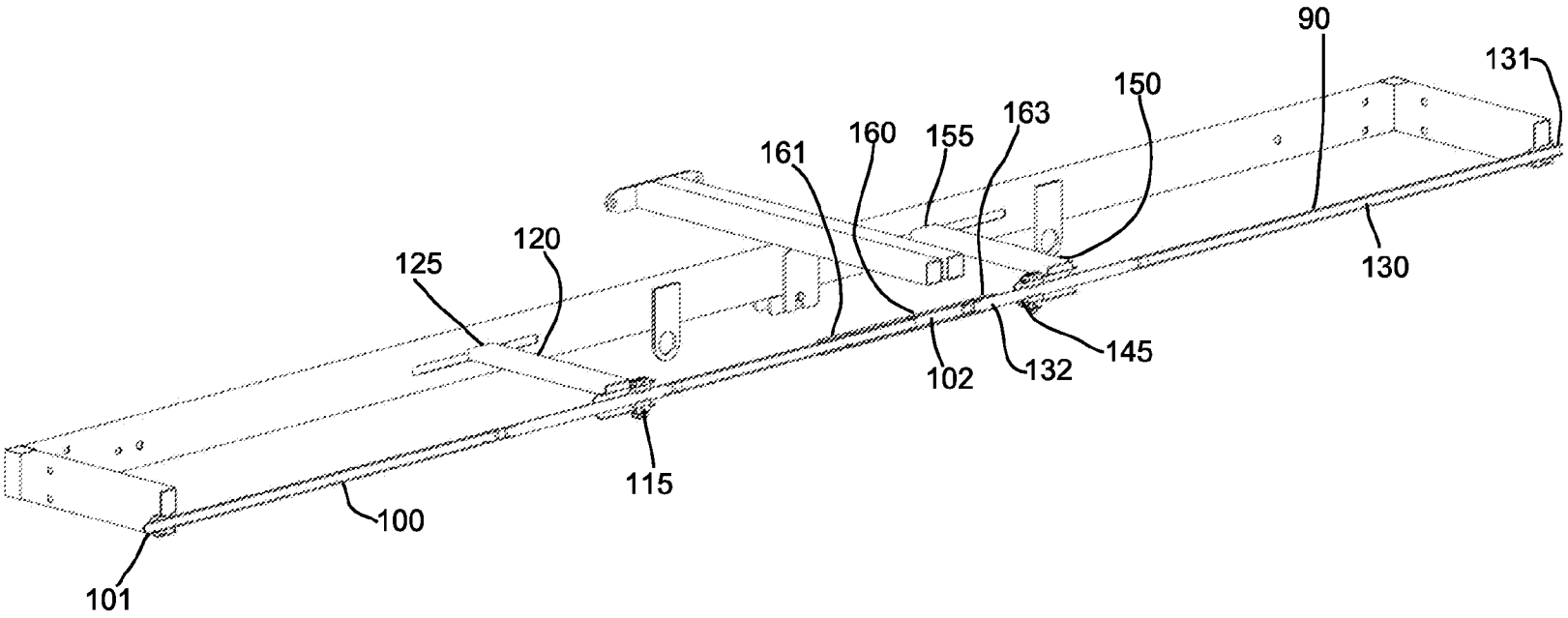
FIG. 14 is a cross-sectional view taken along line 14-14 in FIG. 12.
Figure 15:
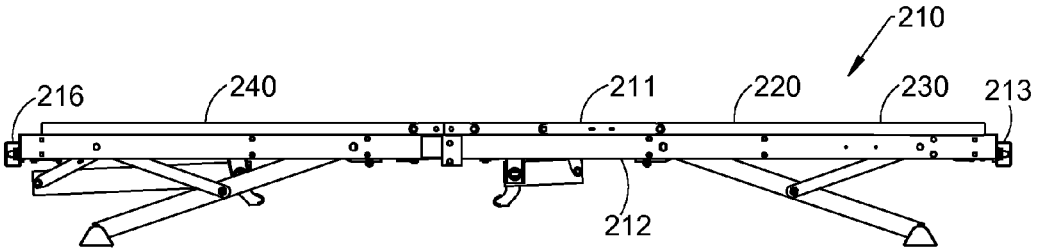
FIG. 15 is a side view of an alternative embodiment of the present invention shown in a low position.

The bed 10 has a deck 20. The deck 20 has a perimeter rail 21. The rail 21 can be formed of rectangular tube material. The deck can have a plurality of laterally extending members between the side rails to support a mattress. A plurality of tabs 22 is provided. In the preferred embodiment, four tabs 22 are provided on each side of the deck. It is appreciated that more or fewer tabs could be provided without departing from the broad aspects of the present invention. The tabs 22 have a top surface that is preferably flush with the top of the deck. Each tab 22 has a slot 23 with an interior end 24. The interior end 24 of the slot 23 is preferably located interior of the rail 21. Tabs are preferably located opposite each other whereby two slots are alignable to accommodate accessory components such as rail tubes. The tabs and slots are best seen in FIG. 13.

A head section 30 is provided. The head section 30 has side rail 31 and side rail 33. Side rail 31 has an end 32. Side rail 33 has an end 34. A member 35 is also provided at the interior end of the head section 30. The member laterally spans between the side rails. Two longitudinal supports 40 and 50 are provided. Support 40 has an end with two spaced apart plates 41 and 44. Plate 41 has a slot 42 and an upwardly extending ear 43. Plate 44 has a slot 45 and an upwardly extending ear 46. Support 50 has an end with two spaced apart plates 51 and 54. Plate 51 has a slot 52 and an upwardly extending ear 53. Plate 54 has a slot 55 and an upwardly extending ear 56.

A foot section 60 is also provided. The foot section 60 has side rail 61 and side rail 63. Side rail 61 has an end 62. Side rail 63 has an end 64. A member 65 is also provided at the interior end of the foot section 60. The member laterally spans between the side rails. Two longitudinal supports 70 and 80 are provided. Support 70 has an end with a carriage 71 that supports a rod 72. The rod 72 preferably extends on both sides of the carriage 71 in a direction generally perpendicular to the longitudinal axis of the support. Support 80 has an end with a carriage 81 that supports a rod 82. The rod 82 preferably extends on both sides of the carriage 81 in a direction generally perpendicular to the longitudinal axis of the support. Rods 72 and 82 are preferably parallel to each other and collinear with each other.

Figure 11:
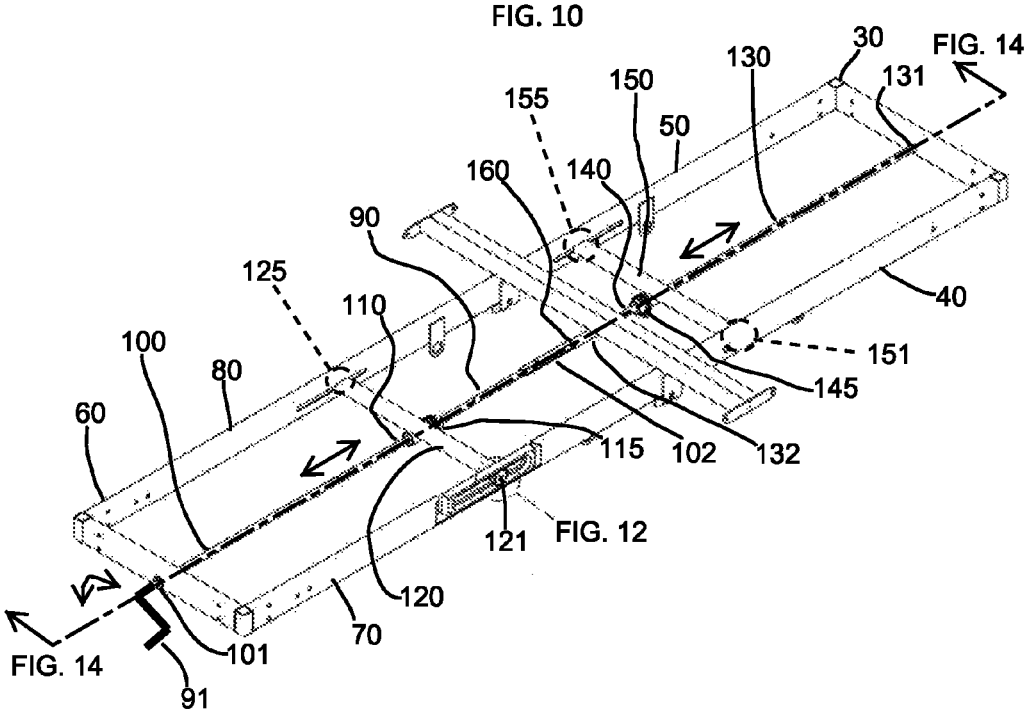
FIG. 11 is a perspective view showing the drive assembly of the present invention.
Figure 12:
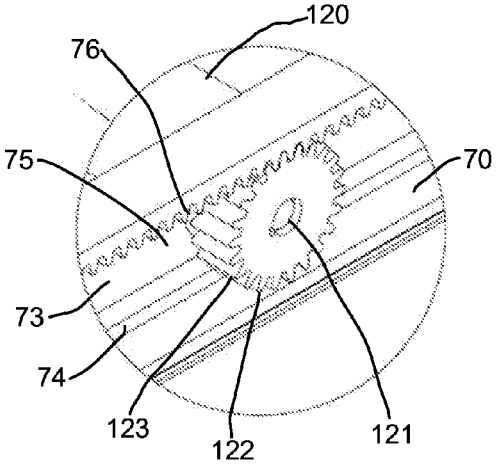
FIG. 12 is a close-up view of a preferred translator of the present invention.

Longitudinal support 70 further has side walls, a top and a bottom that define an interior 75. The inside side wall 73 is preferably slotted with a slot 74. A rack 76 can be housed within the interior 75. The rack 75 preferably is on the top of the longitudinal support above the slot 74. The rack is best illustrated in FIGS. 11 and 12.

It is preferred that each support 40, 50, 70 and 80 have a rack 75. Yet, it is understood that alternative structures could be provided without departing from the broad aspects of the present invention.

Figure 5:
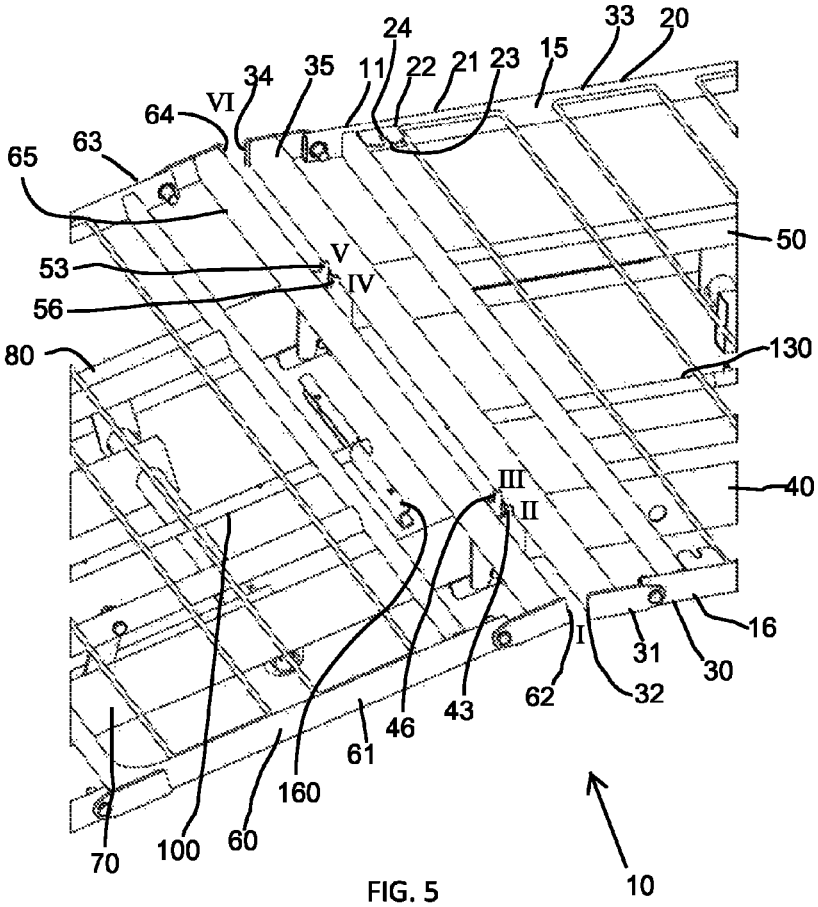
FIG. 5 is a perspective view showing the head and foot sections pivoted wherein the sections do not have six points of contact.
Figure 6:
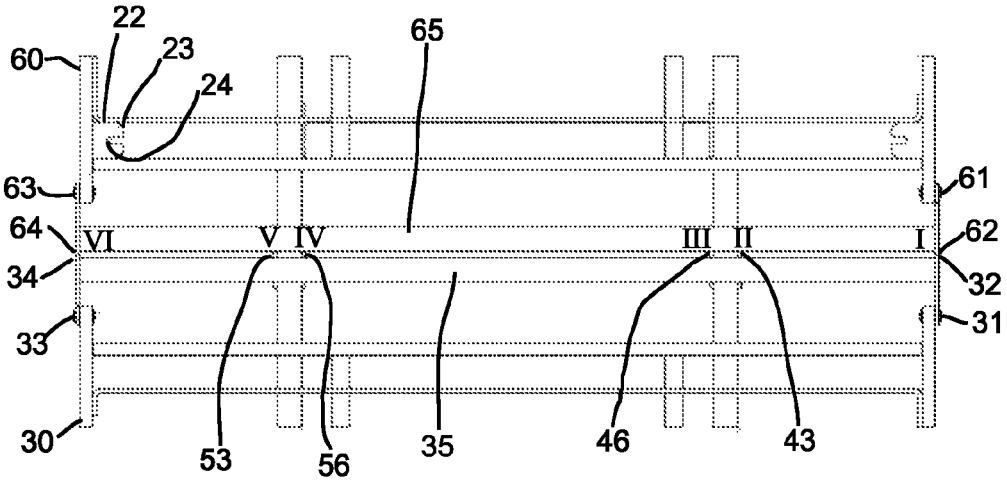
FIG. 6 is a top view showing the head and foot sections connected together.
Figure 7:
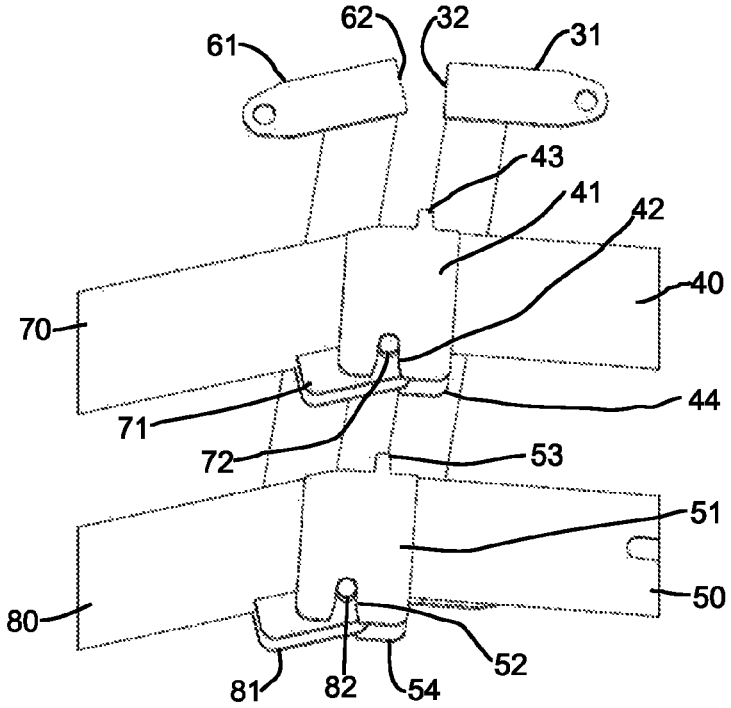
FIG. 7 is a close up bottom view showing the connection between the head and foot sections of the bed.
Figure 8:
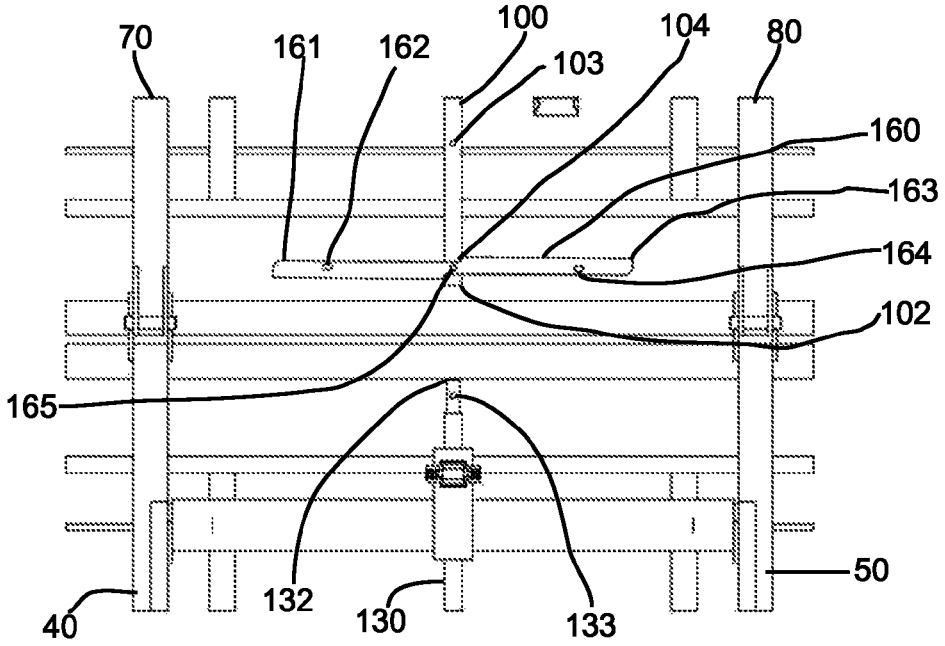
FIG. 8 is a bottom view showing the drive assembly unconnected.
Figure 9:
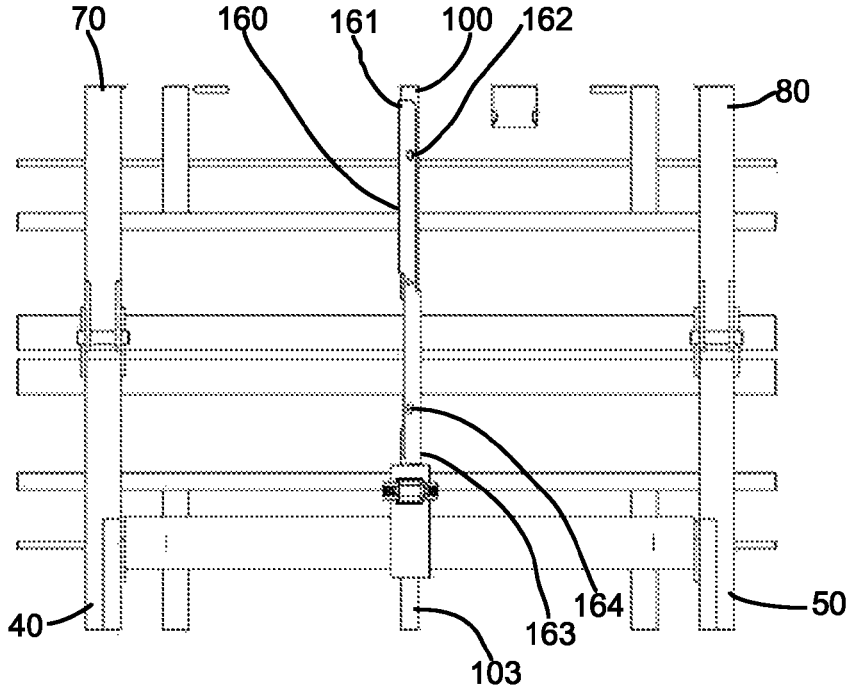
FIG. 9 is similar to FIG. 8, but shows the drive assembly connected.

The head and foot sections are joined together as best seen in FIGS. 5-7. The connection is a pivotal connection. In this regard, the rod 72 is received within slot 42 of plate 41 and slot 45 of plate 44. Rod 82 is received with slot 52 of plate 51 and slot 85 of plate 84.

Further, six points of contact are provided (as noted by I-VI in FIG. 5) when the sections are fully connected. The points are specifically end 32 against end 62. End 34 against end 64. Ears 43 and 46 against member 65. Ears 53 and 56 also act against member 65. It is appreciated that under a vertical load condition, the head and foot sections 30 and 60 respectively will compress onto each other at these six contact points about the pivotal connection described above. It is further appreciated that more or fewer contact points can be provided without departing from the broad aspects of the present invention.

Turning now to FIGS. 8-11 and 14, it is seen that a preferred embodiment of a drive assembly 90 is provided. The drive assembly 90 is used to raise and lower the bed. The drive assembly has a first shaft 100 and a second shaft 130. The shafts are connectable as described below.

Shaft 100 has ends 101 and 102. Two holes are provided. Hole 103 is preferably interior of end 102 a selected amount. Hole 104 is preferably at the end 102. A screw section 110 is provided having threads around the outside of the shaft 100. A slip nut 115 is provided that is translatable relative the shaft as the shaft rotates. The slip nut 115 is connected to a cross member 120. The cross member 120 has ends 121 and 125. End 121 can have a translator 122 fixed thereon. The translator 122 is a pinion 123 in a preferred embodiment that can mate with a rack and move relative thereto. Yet, it is appreciated that other translators such as glides, slides or wheels (or other structures) could be used to move within the interior 75 of the support 70 without departing from the broad aspects of the present invention. The end translator preferably is housed within the interior of the longitudinal support. It is further understood that while in a preferred embodiment the cross member ends move within the longitudinal support that alternative arrangements may be made without departing from the broad aspects of the present invention. End 125 is preferably similar to end 121 and is also rotationally fixed relative end 121. In this regard, the ends rotate at the same rate so that the sides of the bed 10 raise and lower at the same rate.

Shaft 130 has ends 131 and 132. Shaft 130 has one hole 103 preferably interior of end 132 a selected amount. A screw section 140 is provided having threads around the outside of the shaft 130. A slip nut 145 is provided that is translatable relative the shaft as the shaft rotates. The slip nut 145 is connected to a cross member 150. The cross member 150 has ends 151 and 155. The ends each have translators thereon for movement within or relative to their respective longitudinal members. End 155 is preferably rotationally fixed relative end 151. In this regard, the ends rotate at the same rate so that the sides of the bed 10 raise and lower at the same rate.

Figure 10:
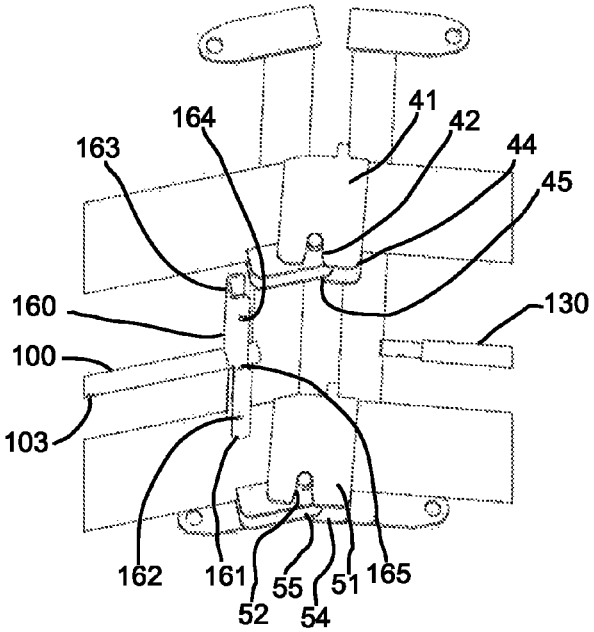
FIG. 10 is a lower perspective view showing that the head and foot sections of the bed can be connected while the drive assembly is unconnected.

Shafts 110 and 130 are preferably removably connected with a connector 160. Connector 160 has an end 161 with a vertical connecting hole 162 there through and an end 163 with a vertical connecting hole 164 there through. A central pivot hole 165 is also provided. The connector 160 can be pivotally connected to the end 102 of shaft 100 with a pivot to hole 104. The connector is pivotal about this connection. The sections of the bed 30 and 60 can be pivotally connected when the connector is unfastened from the second shaft 130. The connector can form a general "T" shape with shaft 100 when fully pivoted. The connector can be pivoted and fixe in alignment with using a both or other connector through holes 162 and 103. The second end can be connected to shaft 130 by use of a connector through holes 164 and 133. In this regard, when the connector 160 is in the connection position, it connects the shafts 100 and 130 so that they act as a singular drive assembly rotatable in unison about a drive assembly longitudinal axis. The connector, as seen in FIG. 10, is shaped to receive two shafts (from opposite sides). In this regard, the connector preferably has opposed C shaped channels. It can be formed form a square tube with opposite sides removed. The middle of the connector can have both sides removed so that it can freely pivot about pivot hole 165.

It is appreciated that while shaft 130 is shown at the head section 30 and shaft 100 is shown at the foot section 60, that the orientation could be switched without departing from the broad aspects of the present invention.

Legs 170 and 190 are provided for supporting the deck. While legs 170 and 190 are described herein, it is understood that other structures or leg assemblies could be provided without departing from the broad aspects of the present invention. In this regard, the terms leg are intended to be broadly construed as encompassing single members and assemblies that are either indirectly or directly connected to the deck or Leg 170 has a first end 171 having a tab 172 for being connected to cross member 120. In this regard, the end 171 is pivotally and movably connected relative the deck. The second end 173 is connected to a foot 174. A brace 180 is provided and is pivotally connected to both the deck 20 and the leg 170 to provide support therefor.

Leg 190 has a first end 191 having a tab 192 for being connected to cross member 150. In this regard, the end 191 is pivotally and movably connected relative the deck. The second end 193 is connected to a foot 194. A brace 200 is provided and is pivotally connected to both the deck 20 and the leg 190 to provide support therefor.

Turning now to FIGS. 1-4, the bed is illustrated in various positions. In FIG. 1, the bed is shown in a shipping (non-operational) position. In this regard, the drive assembly is disconnected and the height of the section is minimized.

Figure 2:
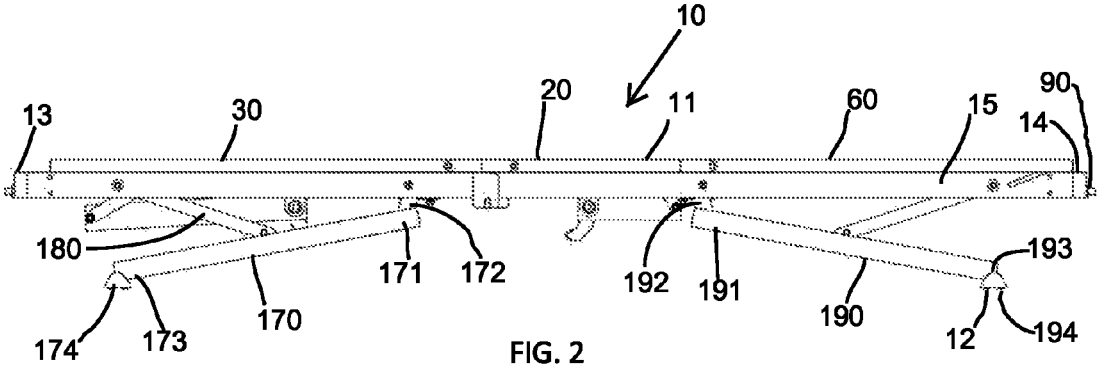
FIG. 2 is a side view of the bed of the present invention shown in a low position.
Figure 3:
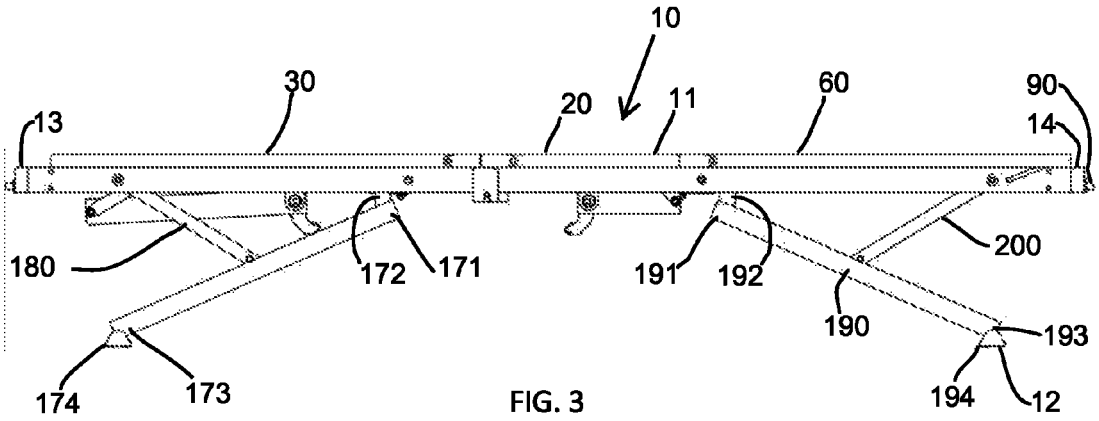
FIG. 3 is a side view of the bed of the present invention shown in an intermediate position.
Figure 4:
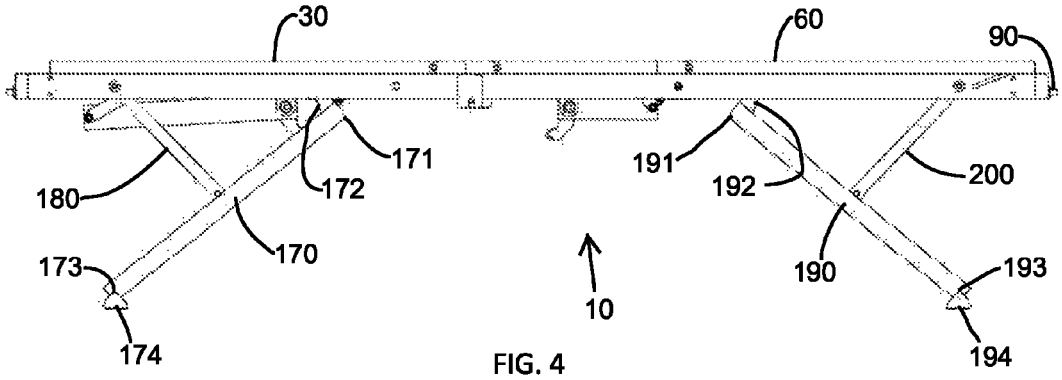
FIG. 4 is a side view of the bed of the present invention shown in a high position.

The bed 10 is shown in the low, an intermediate and the high positions in FIGS. 2-4, respectively. The drive assembly is functional and connected when the bed is in these positions. It is understood that the drive assembly 90 causes both the ends to raise and lower at the same time as the ends of the legs pivot and translate relative the deck. The translators of the respective cross members maintain proper alignment of the sides relative the longitudinal members.

Also in FIG. 11, it is seen that a crank 91 is provided for turning the drive assembly. Turning the crank in a first rotational direction causes the shafts to turn in one direction causing the cross bars and hence legs to pivot and move in one longitudinal direction and rotation in the opposite rotational direction causes the legs to pivot and move in the opposite directions, respectively.

Turning now to FIGS. 15-22, it is seen that an alternative embodiment of a bed 210 with a top 211 and a bottom 212 is illustrated.

Bed 210 further has an end 213. A bar 214 with a hole 215 there through is provided at end 213. The bar 214 is preferably centrally located at the end of the bed. An end 216 is opposite of end 213. A bar 217 with a hole 218 is centrally located at the end 216 of the bed 210. Bars 214 and 217 are rotatably housed relative (and preferably concealed within) the respective sections of the bed ends. A crank can be connected to one of the bars to rotate a drive assembly.

The bed 210 further has a deck 220. Deck 220 has a head section 230 and a foot section 240. Head section 230 has a slot 231 with ends 232 and 233 formed therein. Foot section 240 also has a slot 241 with ends 242 and 243.

A drive assembly 250 having a longitudinal axis 251 is further provided. The drive assembly has a first shaft 260 and a second shaft 270. First shaft 260 has an end 261 with a hole 262 shaped to receive a pin 263. Second shaft 270 has an end 271 with a hole 272 shaped to receive a pin 273.

The shafts 260 and 270 can be selectably connected and disconnected from each other. When connected, end 261 of shaft 260 is coupled with shaft 214 wherein holes 215 and 262 are aligned. Pin 263 passes through holes 215 and 262 to fasten the first shaft 260 to the shaft 214. Further, when connected, end 271 of shaft 270 is coupled with shaft 217 wherein holes 218 and 272 are aligned. Pin 273 passes through holes 218 and 272 to fasten the first shaft 270 to the shaft 217.

When the pins 263 and 273 lock the respective shafts together, the bed is able to be moved from a low position to a high position. This is accomplished by providing a crank to cause the drive assembly to rotate. Rotation of the drive assembly causes leg assemblies to pivot and move longitudinally relative the deck, thereby causing the deck to raise and lower.

This is accomplished at the head section 230 as an upper end 281 of leg 280 is slidably and pivotally received within slot 231. It is understood that while a leg 280 is described, the leg can have the form of an assembly or multi-piece unit that can effectively directly or indirectly act linearly and rotationally relative the deck. When in the high position, the end 281 is at end 232 of the slot. When in the low operational position, the end 281 is at an intermediate position between ends 232 and 233 that is closer to end 233 but not at end 233. Only when the first and second drive shafts are disconnected from each other and end 261 of shaft 260 is disconnected from bar 214, can the end 281 of leg translate or move within the slot 231 all the way to end 233. This further movement and rotation of leg 281 occurs as the first shaft 260 moves inward along the longitudinal axis 251 of the drive assembly 250. This, in turn, causes the overall height of the bed to decrease an additional amount to a low shipping or storage height. In the preferred embodiment, this height is 7 inches, which is 3 inches lower that the overall height when in the low operational position.

Figure 19:
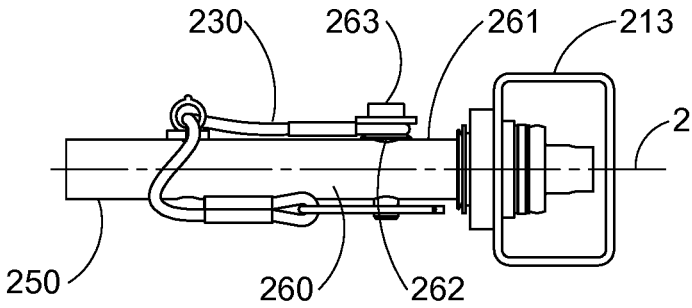
FIG. 19 is an isolated side view of the drive assembly joined with a shaft at the end of the bed to prevent the bed from entering a shipping low position.
Figure 20:
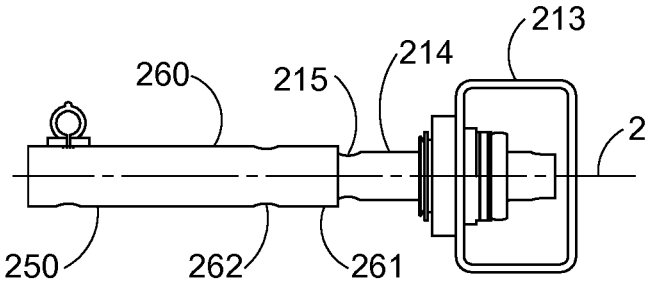
FIG. 20 is an isolated side view of the drive assembly at the end of the bed disjoined from the shaft at end of the bed to allow the bed to be placed in a shipping low position.
Figure 21:
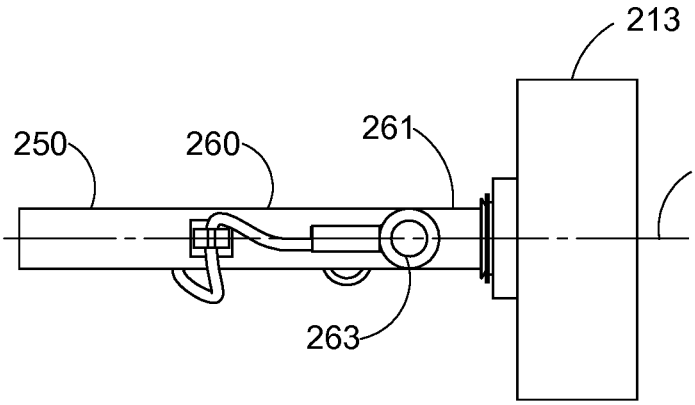
FIG. 21 is an isolated top view of the drive assembly joined with a shaft at the end of the bed to prevent the bed from entering a shipping low position.
Figure 22:
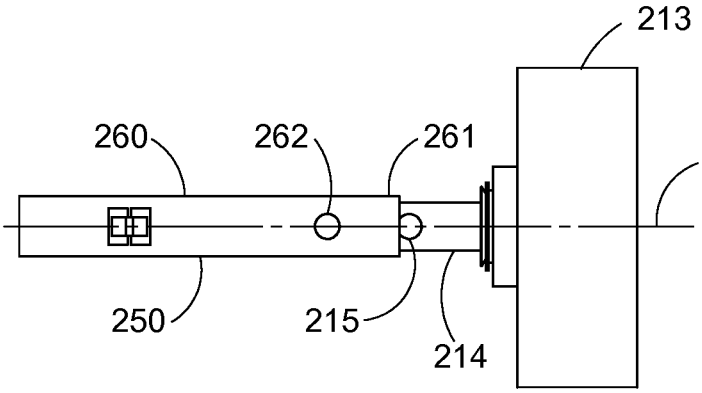
FIG. 22 is an isolated side view of the drive assembly at the end of the bed disjoined from the shaft end of the bed to allow the bed to be placed in a shipping low position.

The end 261 of shaft 260 is shown telescopically engaged and fastened with bar 214 in FIGS. 19 and 21, and is shown unfastened and longitudinally separated in FIGS. 20 and 22.

The foot section 240 as an upper end 286 of leg 285 is slidably and pivotally received within slot 241. In this regard, when in the high position, the end 286 is at end 242 of the slot. When in the low operational position, the end 286 is at an intermediate position between ends 242 and 243 that is closer to end 243 but not at end 243. Only when the first and second drive shafts are disconnected from each other and end 271 of shaft 270 is disconnected from bar 217, can the end 286 of leg translate or move within the slot 241 all the way to tend 243. This further movement and rotation of leg 286 occurs as the second shaft 270 moves inward along the longitudinal axis 251 of the drive assembly 250. This, in turn, causes the overall height of the bed to decrease an additional amount to a low shipping or storage height. In the preferred embodiment, this height is 7 inches, which is 3 inches lower that the overall height when in the low operational position.

It is appreciated that the respective outer ends of shaft 260 and 270 operate similarly relative the respective ends 213 and 216 of the bed 210.

Figure 16:
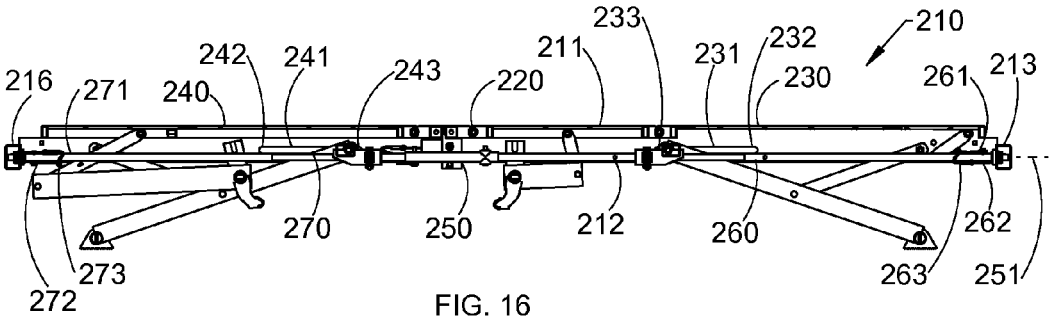
FIG. 16 is a cross-sectional side view of the view illustrated in FIG. 15.
Figure 16A:
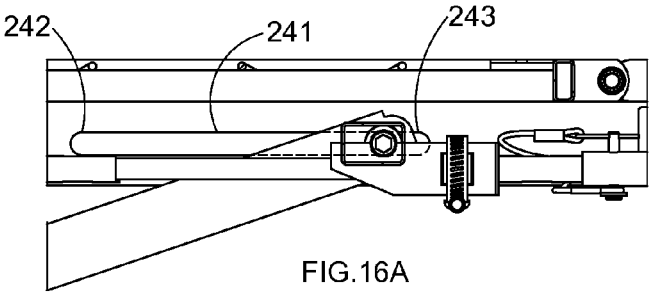
FIG. 16A is close up of a portion of the bed illustrated in FIG. 16.
Figure 16B:
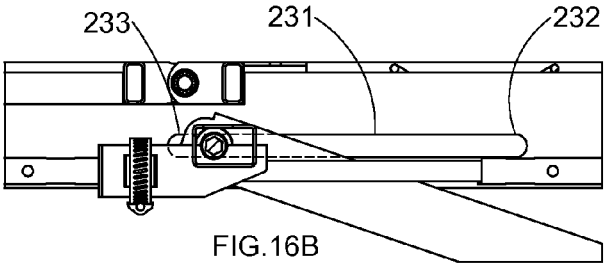
FIG. 16B is a close up of a portion of the bed illustrated in FIG. 16.
Figure 17:
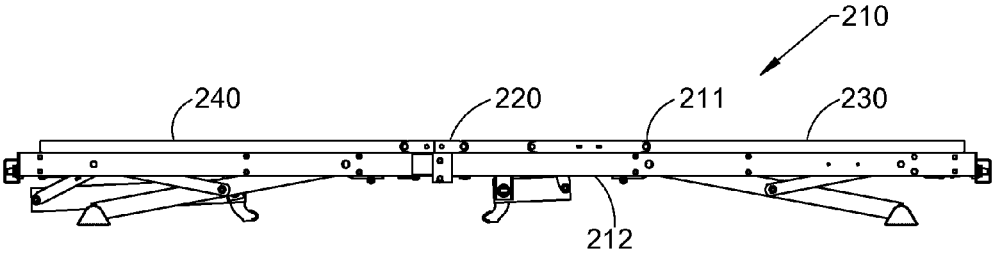
FIG. 17 is a side view of the embodiment illustrated in FIG. 15 but shown in a shipping position having a lower height than a normal low position.
Figure 18:
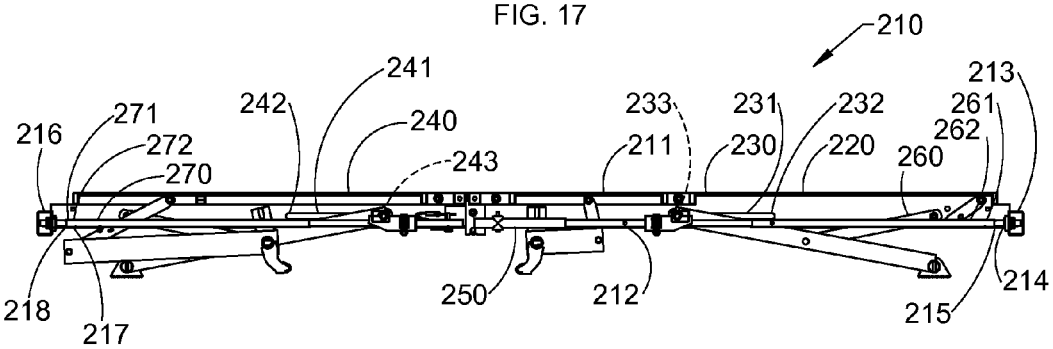
FIG. 18 is a cross-sectional side view of the view illustrated in FIG. 17.
Figure 18A:
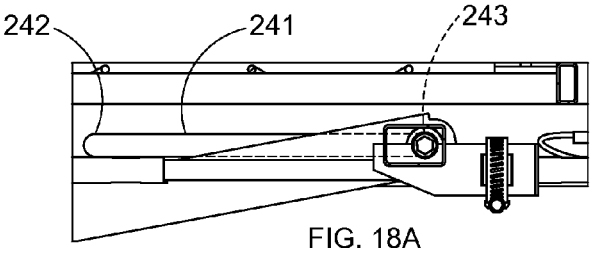
FIG. 18A is close up of a portion of the bed illustrated in FIG. 18.
Figure 18B:
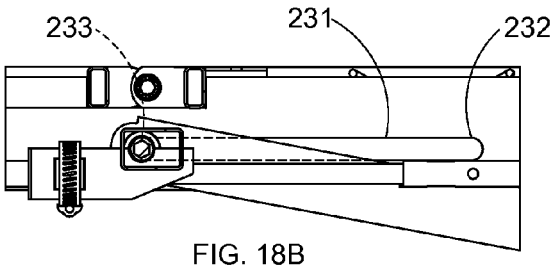
FIG. 18B is a close up of a portion of the bed illustrated in FIG. 18.

Further, FIGS. 16A and 16B illustrate the position of the leg assembly relative the slots 231 and 241 receptively in the low position wherein the legs are connected at portions near but not at the ends of the slots. FIGS. 18A and 18B illustrate the position of the leg assembly relative the slots 231 and 241 receptively in the shipping position wherein the legs are at the end of the slots. It is appreciated that braces, which are pivotally connected to the legs and to the side rails at fixed locations, cause the legs to rotate as their respective upper ends move relative the side rails.

Figure 23:
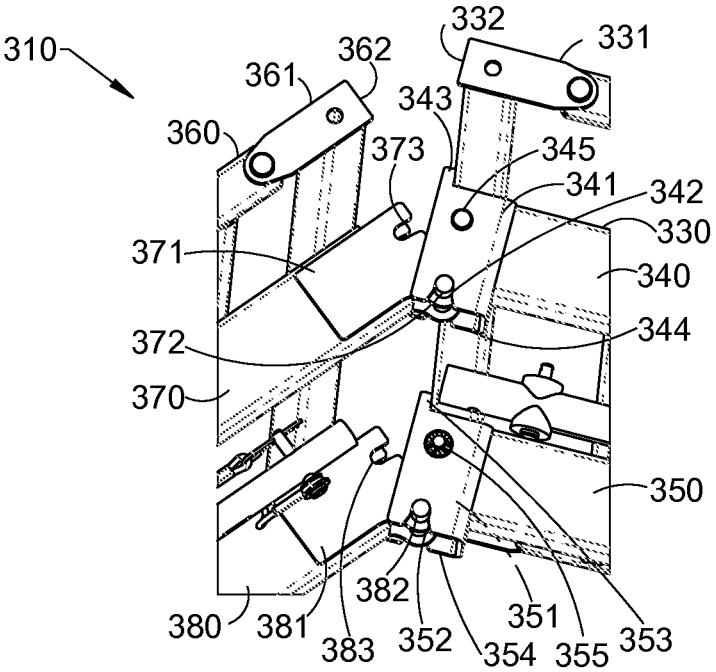
FIG. 23 is a perspective view of an alternative embodiment of the present invention showing an alternative additional connecting pin of the present invention.
Figure 23A:
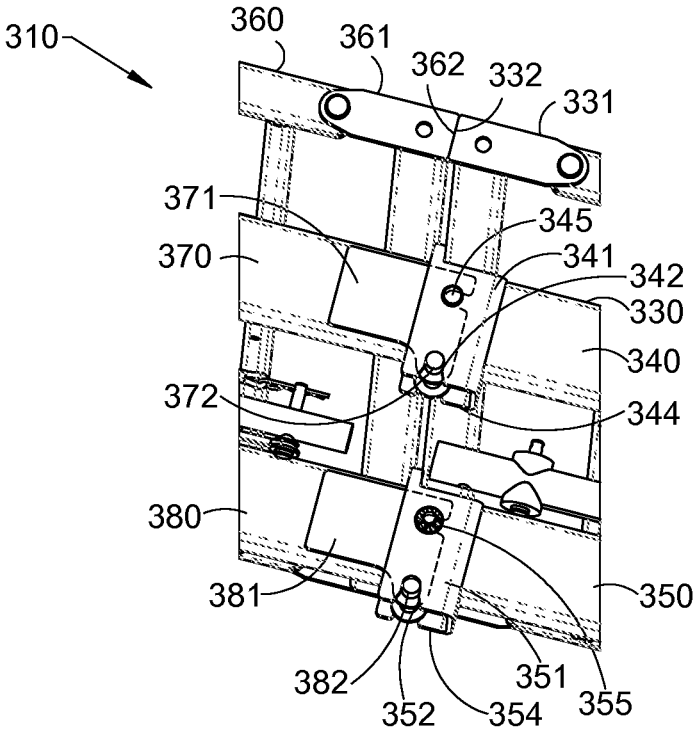
FIG. 23A is similar to FIG. 23 but shows the bed sections rotated to a combined orientation.

Turning now to FIGS. 23 and 23A, it is seen that an additional alternative embodiment is illustrated. In particular a bed 310 is provided. The bed 310 has a head section 330 with a side rail 331 with an end 332. A longitudinal support 340 is further provided having a plate 341 with a slot 342 and an ear 343. A second plate 344 is provided also having a slot and an ear. A pin 344 is removably provided and is received through holes in plates 341 and 344. It is understood that in a preferred embodiment, that the pin 345 can be received through plates 341 and 345 after internal components are placed within the side rail 331. An additional longitudinal support 340 is further provided having a plate 351 with a slot and an ear 353. A second plate 354 also with a slot and an ear is also provided. A pin 355 is received through plates 351 and 354.

The bed 310 also has a foot sections with a side rail 361 having an end 362. A first longitudinal support 370 is provided. Support 370 has a carriage 371 with a rod 372. Slits 373 are formed in two side walls of the carriage 371. The slits define an axis that is generally parallel to a longitudinal axis of the rod 372. A second longitudinal support 380 is also provided. The support 380 has a carriage 381 with a rod passing between the side walls of the carriage. Slits 383 are formed in the side walls of the carriage. While the openings are described as slits, any type of recess, opening or gap is considered within the scope of the present invention.

Support 340 mates with support 370 to join the head and foot sections of the bed. This is accomplished by first placing rod 372 within slot 342. Then, the head and foot sections 330 and 360, respectively, are rotated towards each other about the axis defined by the rod. The sections continue to rotate until pin 341 is received within slits 373. When pin 341 is received within slits 373, it is seen that pin 345 provides vertical support while pin 372 provides longitudinal support. It is appreciated that while two slits are described, that one slit or slotted structure could alternatively be provided to receive a pin without departing from the broad aspects of the present invention.

Support 350 mates with support 380 to join the head and foot sections of the bed in the same manner and simultaneously as when support 340 and 370 mate. In this regard, when joined, pin 345 provides vertical support and pin 382 provides longitudinal support.

Figure 24:
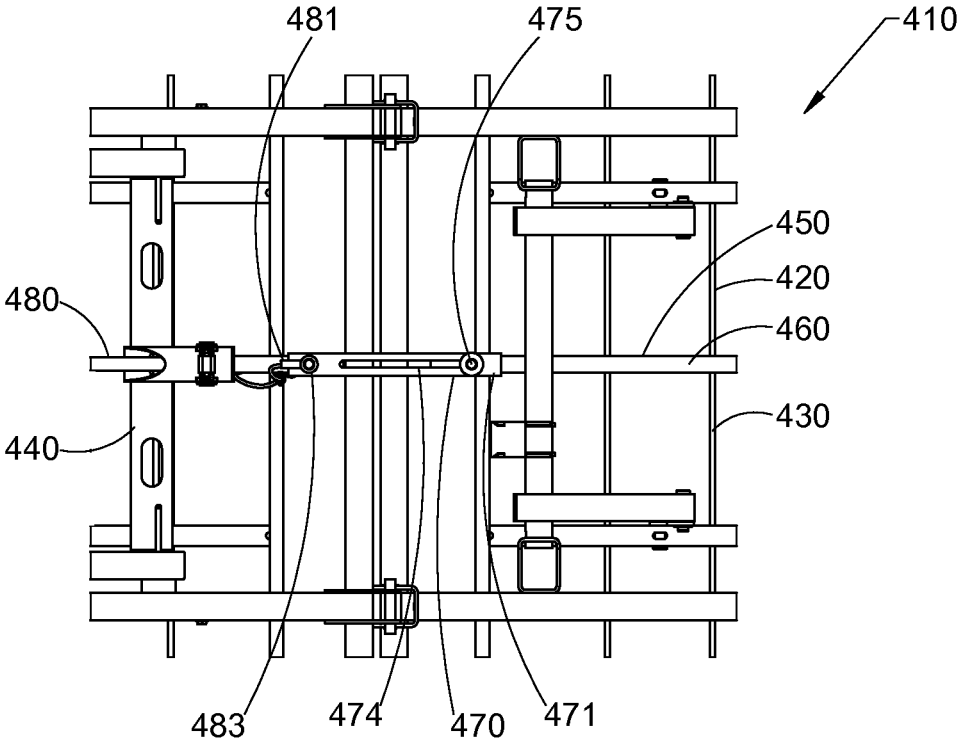
FIG. 24 is a bottom view showing an alternative embodiment of a drive assembly connection illustrated in a connected manner.
Figure 25:
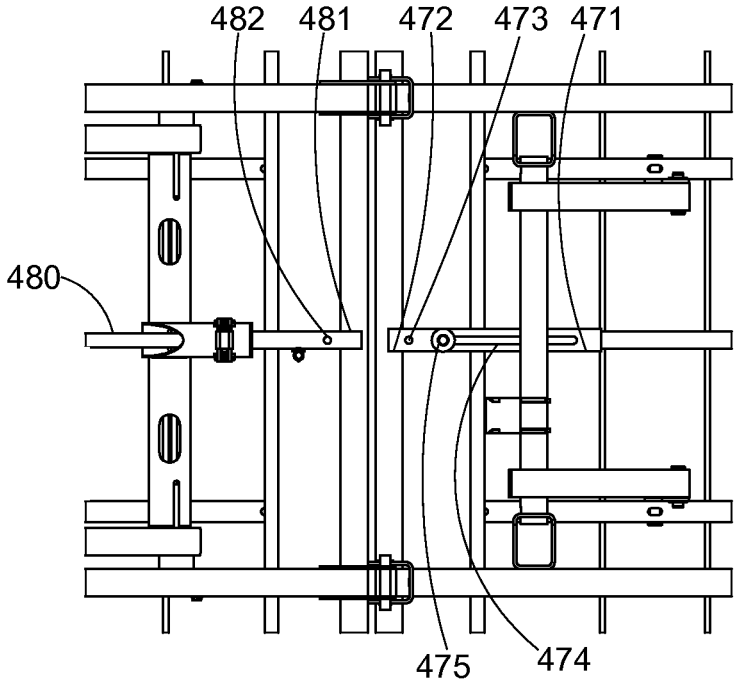
FIG. 25 is similar to FIG. 24, but shows the two shafts of the drive assembly in a disconnected manner.
Figure 26:
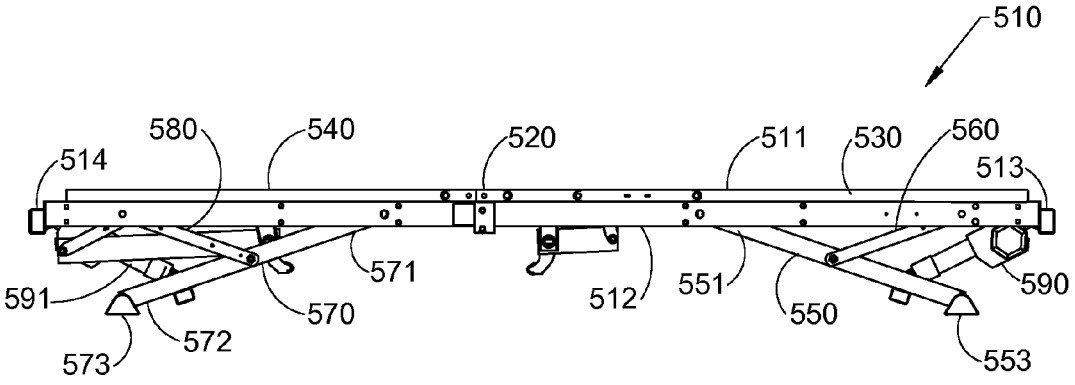
FIG. 26 is a side view showing an alternative embodiment of the present invention with actuators shown in a low position.
Figure 27:
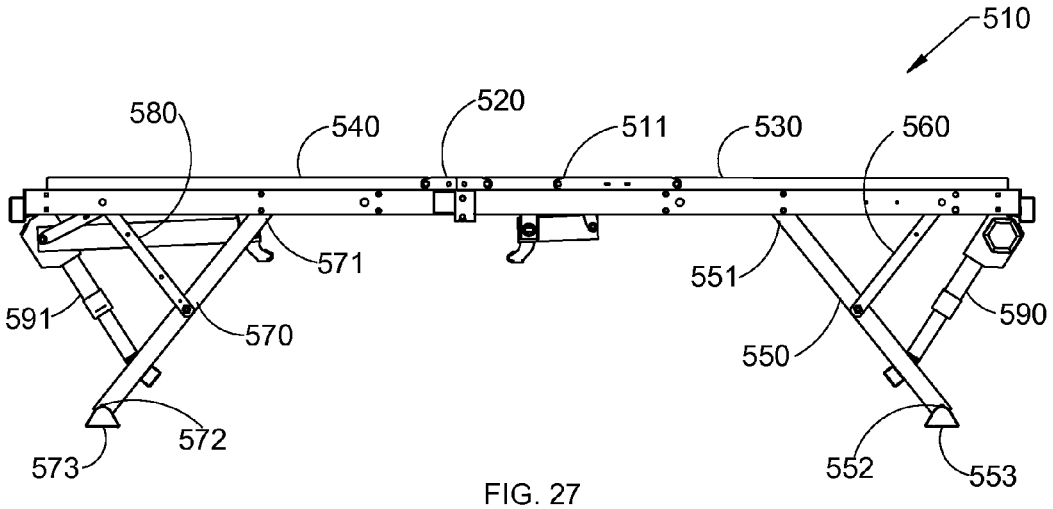
FIG. 27 is similar to FIG. 26, but shows the bed in a high position.
Figure 28:
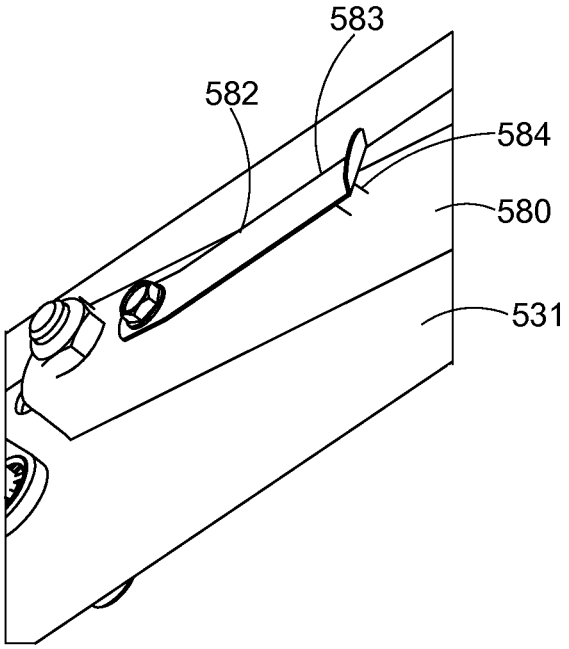
FIG. 28 is a close up perspective view of a spring clip in the undeployed position.
Figure 29:
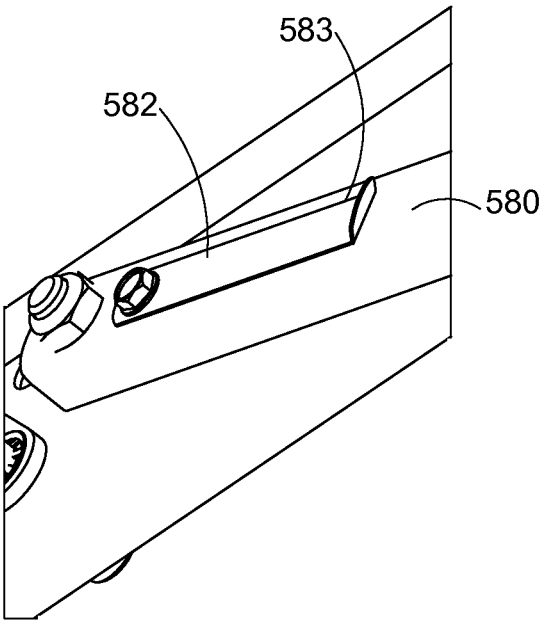
FIG. 29 is similar to FIG. 28, but shows the spring clip in the deployed position.
Figure 30:
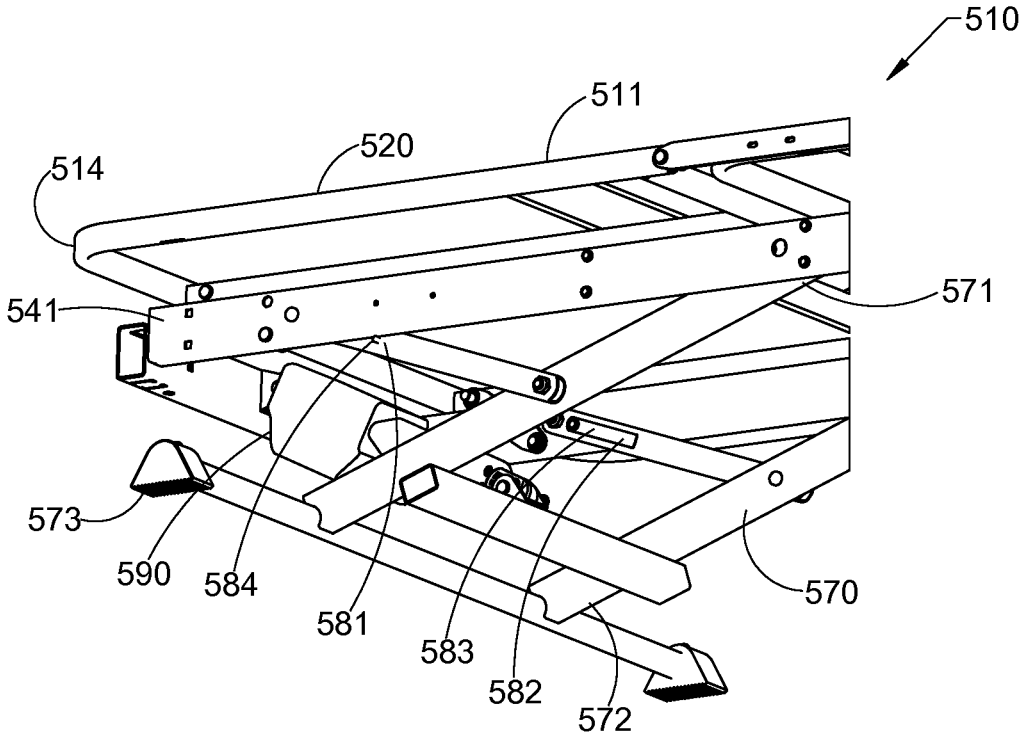
FIG. 30 is a perspective view showing a limiting the vertical travel of the foot end of the bed.
Figure 31:
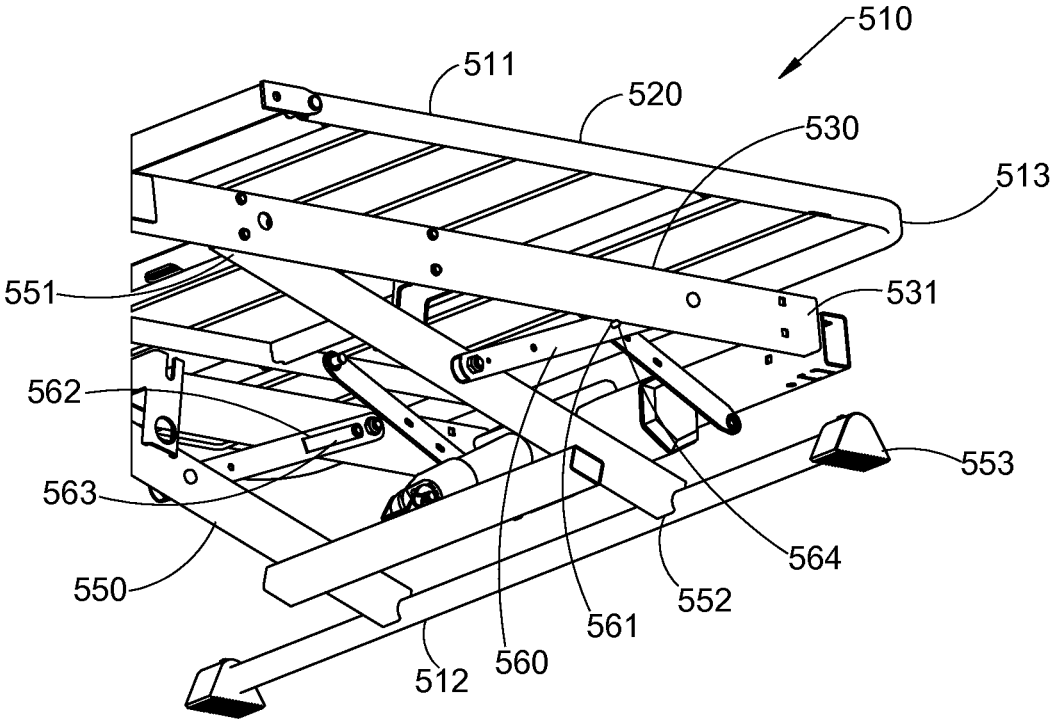
FIG. 31 is a perspective view showing a limiting the vertical travel of the head end of the bed.

Turning now to FIGS. 24-25, it is seen that yet another alternative embodiment of the present invention is illustrated. A bed 410 is shown having a deck 420 with a head section 430 and a foot section 440. A drive assembly 450 is provided having a first shaft 460 that is removably joinable with a second shaft 480.

Shaft 460 has an extension 470 having ends 471 and 472. The extension 470 is preferably telescopically slidable relative the shaft. The extension 470 has a hole there through at end 471. The extension 470 further has a slot spanning longitudinally through the extension sidewall. A post 475 is fixed to the shaft 460 and acts as a guide to limit the travel of the extension relative the shaft via the ends of the slot.

Shaft 480 has an end 481 with a hole 482 there through.

Extension 470 can be connected telescopically to shaft 480. When in such a position, a pin 483 can pass through holes 473 and 482, respectively, to join the first shaft to the second shaft. The shafts can be disconnected by removing the pin 483 from the holes and retracting the extension. The first shaft 460 and second shaft 480 are shown connected in FIG. 24 and shown disconnected in FIG. 25.

Turning now to FIGS. 26-31, it is seen that a still further embodiment of the present invention is illustrated. Bed 510 is illustrated having a top 511, a bottom 512 and opposed ends 514 and 514. A deck 520 is provided. The bed has a head section 530 with a side rail 531 and a foot section 540 with a side rail 541.

A leg 550 is at the head section 530 and is pivotally and slidably connected to the side rail 531. The leg 550 has a first end 551 and a second end 552. A foot 553 is at the second end 553. A brace 560 is pivotally connected to both the side rail 531 and the leg 550. A hole 561 passes through the brace 560. A spring clip 562 having a spring 563 or spring element and a pin 564 is provided. The spring 563 can bias the pin 564 to pass through and extend out of hole 561 in the brace.

While a spring clip 562 is illustrated, other types of mechanical limitation devices may be used without departing from the broad aspects of the present invention.

A leg 570 is at the foot section 540 and is pivotally and slidably connected relative to the side rail 541. The leg 570 has a first end 571 and a second end 572. A foot 573 is at the second end 572. A brace 580 is pivotally connected to both the deck 520 and the leg 570. A hole 581 passes through the brace 580. A spring clip 582 having a spring 583 or spring element and a pin 584 is provided. The spring 583 can bias the pin 584 to pass through and extend out of hole 581 in the brace.

An actuator 590 is provided to selectably raise and lower the head section 530. An actuator 591 is provided to selectably raise and lower the foot section.

In a shipping position, the pin 564 is prevented from extending through the hole 561 as end of pin is contacted by the deck rails. Once the bed is raised a sufficient amount from the shipping position and the deck rails no longer prevent the pin from extending through the hole, the spring 563 forces the pin 564 out form the hole 561. In this regard, the pin 564 provides a stop to prevent the bed from going any lower than when the side rails of the deck engage the pin. Thus, the pin prevents the bed from going to the low shipping position unless the user intentionally retracts the pin 564 into the hole.

In a shipping position, the pin 584 is prevented from extending through the hole 581 as end of pin is contacted by the deck rails. Once the bed is raised a sufficient amount from the shipping position and the deck rails no longer prevent the pin from extending through the hole, the spring 583 forces the pin 584 out form the hole 581. In this regard, the pin 584 provides a stop to prevent the bed from going any lower than when the side rails of the deck engage the pin. Thus, the pin prevents the bed from going to the low shipping position unless the user intentionally retracts the pin 584 into the hole.

It is understood that a leg need not be directly connected to a deck or side rail in order to be considered to be movably and pivotally connected thereto. In this regard, it is appreciated that indirect connections are within the scope of the present invention.

Thus it is apparent that there has been provided, in accordance with the invention, an improved bed that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A bed comprising:

a head section having:

a head section first side rail with a head section first side rail end;

a head section second side rail with a head section second side rail end;

a head section first longitudinal support with a head section first longitudinal support first ear and a head section first longitudinal support second ear;

a head section second longitudinal support with a head section second longitudinal support first ear and a head section second longitudinal support second ear; and a foot section having:

a foot section first side rail with a foot section first side rail end;

a foot section second side rail with a foot section second side rail end; and a foot section end member, wherein said head section and said foot section are joinable with six points of contact including:

contact between said head section first side rail end and said foot section first side rail end;

contact between said head section second side rail end and said foot section second side rail end; and contact between said foot section end member and:

said head section first longitudinal support first ear;

said head section first longitudinal support second ear;

said head section second longitudinal support first ear; and said head section second longitudinal support second ear.

2. The bed of claim 1 wherein:

said head section first longitudinal support comprises a slot; and said foot section has a foot section carriage supporting a rod, said rod being insertable into said slot wherein said head section and said foot section are rotatably connected.

3. The bed of claim 2 wherein:

said foot section carriage defines a slit; and said head section first longitudinal support further comprises a pin, said pin being inserted into said slit when said head section is rotated relative said foot section.

* * * * *